US008801127B2

(12) United States Patent
Ben-Zur

(10) Patent No.: US 8,801,127 B2
(45) Date of Patent: Aug. 12, 2014

(54) METHOD AND APPARATUS FOR SAFE USE OF A WET ON WET TEXTILE PRINTER

(75) Inventor: Ofer Ben-Zur, Hod-HaSharon (IL)

(73) Assignee: Kornit Digital Technologies Ltd., Rosh HaAyin (IL)

( * ) Notice: Subject to any disclaimer, the term of this patent is extended or adjusted under 35 U.S.C. 154(b) by 769 days.

(21) Appl. No.: 13/017,054

(22) Filed: Jan. 31, 2011

(65) Prior Publication Data

US 2012/0194583 A1 Aug. 2, 2012

(51) Int. Cl.
*B41J 29/38* (2006.01)

(52) U.S. Cl.
USPC ..... 347/9; 347/5

(58) Field of Classification Search
USPC ..... 347/9
See application file for complete search history.

(56) References Cited

U.S. PATENT DOCUMENTS

| | | | | |
|---|---|---|---|---|
| 5,637,265 | A * | 6/1997 | Misciagno et al. | 264/1.7 |
| 2004/0181681 | A1 | 9/2004 | Salisbury | |
| 2005/0174371 | A1 | 8/2005 | Deshmukh | |
| 2009/0090257 | A1* | 4/2009 | Feldman et al. | 101/114 |

FOREIGN PATENT DOCUMENTS

| | | | | |
|---|---|---|---|---|
| EP | 0878307 | | 11/1998 | |
| EP | 1600301 | | 11/2005 | |
| EP | 2259229 | | 12/2010 | |
| JP | EP1600301 | A1 * | 9/2004 | B41J 29/38 |
| WO | WO 99/65695 | | 12/1999 | |
| WO | WO 2005/076730 | | 8/2005 | |
| WO | WO 2005/115089 | | 12/2005 | |
| WO | WO 2009/074182 | | 6/2009 | |

OTHER PUBLICATIONS

Communication Pursuant to Rules 70(2) and 70a(2) EPC and Reference to Rule 39(1) EPC Dated Feb. 4, 2013 From the European Patent Office Re. Application No. 11157603.9.
European Search Report and the Search Opinion Dated Jan. 7, 2013 From the European Patent Office Re. Application No. 11157603.9.
Communication Under Rule 71(3) EPC Dated Sep. 26, 2013 From the European Patent Office Re. Application No. 11157603.9.

* cited by examiner

*Primary Examiner* — Uyen Chau N Le
*Assistant Examiner* — Kajli Prince

(57) ABSTRACT

A wet on wet garment printing device for printing on a textile surface comprises: an ink holder; a printing head mounted for printing onto the textile surface using ink from the ink holder; a wetting applicator for wetting the locations prior to printing using a wetting composition; and an ink regulator configured to identify compatibility of ink in the holding unit with the wetting composition and to operate the wetting applicator only upon successful identification of compatibility.

21 Claims, 6 Drawing Sheets

METHOD AND APPARATUS FOR SAFE USE OF A WET ON WET TEXTILE PRINTER

FIELD AND BACKGROUND OF THE INVENTION

The present invention relates to a device and method for ensuring safe and qualitative use of a wet on wet textile printer and, more particularly, but not exclusively to a method and apparatus that prevents chemical effects of the wetting agent that occur in the presence of inks not specially designed for the wetting agent, or for chemical reactions between the wetting agent and the wrong kind of ink.

The present embodiments relate to a method and apparatus of preventing health hazards to an operator or others in the vicinity of wet printing of textiles, or damage to the printed garment or damage to equipment.

Digital printing on garments or textiles in general, is performed by very small droplets containing miniscule amounts of colorant. To obtain an image with acceptable intensity the ink drops should not be permitted to enter the bulk of fabric but rather should display all the colorant at the fabric's surface.

Many existing digital printers use pretreatment procedures which generate an impregnated layer on the surface of the fabric and print the image on the layer. This is the wet on dry process, and the layer prevents the ink drops from being absorbed into the fabric.

Wet on dry generally prevents the ink from penetrating into the textiles so that the present issue does not arise.

Generally this is conceived by applying an under layer or base layer by spraying the substrate with suitable solution, and drying or more usually heat pressing, that result in a uniform planar base which may accept and immobilize the jetted ink droplets of the digital printing.

Wet on wet printing however not only allows the ink to enter the fabric but indeed the wetting composition may enable free flow and mix of the inks on the substrate, thus exacerbating the problem. The wet on wet printing of the present applicants is described, for example, in International Patent Publication Nos. WO 2005/076730 and WO 2005/15089, and also in International Patent Application No. PCT/IL2010/000645, filed Aug. 10, 2010.

In order to ensure that the colorant remains at the fabric surface it is therefore necessary to pretreat the fabric prior to printing. Substrate preparation by treatment is needed to produce a high quality image on the garment or textile.

The pretreatment may be performed by applying ink immobilizing solution, that reacts instantaneously with the digital ink droplets, thus preventing the ink drop from being absorbed into the fabric to disappear, or from bleeding or feathering into adjacent ink droplets. Using immobilizing solution, the image is immediately printed and stabilized upon the wet surface and may subsequently be thermally dried and cured.

The solution used for wetting in the preprinting treatment, which may include ink immobilizing solution, may be chemically active and may react with inks that were not specifically designed to be used with the solution. Such reactions may give rise to discharge of unreacted reagents and be a danger to persons in the vicinity and/or such reactions may cause damages to the fabrics being printed.

A consequence of this is that unless specific inks are used, which can neutralize the major part of the hazardous ingredient in the spray solution during the immobilization process, use of wet on wet printing is not safe.

Besides an application of the immobilizing solution by external sprinkler, the ink immobilizing solution may be supplied to the fabric through a printhead such as an inkjet print head. Supply of the ink immobilizing solution may be simultaneous with the printing or may precede the printing, and the use of a print head allows for precise placement of the immobilizing solution in relation to the region to be printed.

Furthermore there are often workplace requirements and safety regulations that set maximum exposure levels for many substances. It is therefore necessary for anyone installing wet on wet printing equipment to keep traces of regulated materials that reach the operator below the allowed exposure levels (TWA-STEL).

One way of avoiding exceeding the permitted levels of the regulated components in the pretreatment solution regulated components, is to provide neutralizing components in the inks that neutralize the regulated components.

Suitable ink formulations are therefore designed with neutralizing components in such a way that when applied on the pretreatment solution, significant components of the droplet immobilizing materials of the pretreatment solution are neutralized, thus keeping their concentration in air under the limit levels.

As described in International Patent Publication No. WO 2005/15089 and International Patent Application No. PCT/IL2010/000645, the ink immobilization is effected by instantaneous restriction of flowability of liquid ink components containing the pigments after the droplet hits the substrate, thus preventing bleeding or feathering.

The colorant immobilization can be performed by, for example, a volatile organic acid, which may form a part of the wetting composition. The acid reacts with a compatible component in the jetted ink to thereby affect congelation of the ink, thus also ensures that the concentration of the acid does not exceed the TWA-STEL values.

Another issue that arises when inks other than the specifically designed inks are used, is preventing damage to the equipment. Such damage may include corrosion and blockage of print heads, which may occur as a result of introduction of incompatible inks into the printer. Print heads are a relatively expensive part of the printing apparatus and it is desirable to avoid the expensive printheads from being blocked.

Another issue that arises from use of inks not designed to be used with the wetting composition is protection of the garments to be printed from damage and being ruined.

Inks that lack wet on wet immobilization features may furthermore be diluted by the solution and the adjacent drops may therefore bleed one into another. Thus the resulting image is of reduced or very low quality, and the garment may be destroyed.

SUMMARY OF THE INVENTION

According to one aspect of the present invention there is provided a wet on wet garment printing device for printing on a textile surface comprising:

an ink holder for holding ink;

a printing head mounted for printing onto locations of the textile surface using ink from the ink holder;

a wetting applicator for wetting the locations prior to printing using a wetting composition; and an ink regulator configured to identify ink in the holding unit and to operate the wetting applicator for the wetting only upon successful identification of the ink.

In an embodiment, the operating of the wetting applicator only upon successful identification of the ink is achieved by shutting off supply, to the wetting applicator, of the wetting composition upon unsuccessful identification of the ink.

In an embodiment, the wetting applicator comprises a digital printhead configured for printing according to digital printing data, and whereupon the device is configured such that the digital printing data is sent to the wetting applicator only upon successful identification of the ink.

In an embodiment, the ink is held in cartridges, ink compatibility information is stored electronically in electronic storage media in the cartridges, and the ink regulator is configured to obtain the ink identification information by interrogating the electronic storage media.

In an embodiment, the electronic storage media in the cartridges comprises passive storage, and the ink regulator comprises an active reader.

In an embodiment, the storage media comprises magnetic storage and the ink regulator comprises a magnetic reader.

In an embodiment, the storage media comprises a passive radio frequency identification—RFID—tag and the ink regulator comprises an RFID reader. In an embodiment, the electronic storage media in the cartridges comprises active storage.

In an embodiment, the storage media comprises an active radio frequency identification—RFID—tag and the ink regulator comprises an RFID reader.

In an embodiment, the storage media comprises a microchip.

In an embodiment, the identification comprises identifying a compatibility of the ink with the wetting composition.

In an embodiment, compatible inks comprise a neutralizing component for neutralizing an immobilizing component in the wetting composition, and wherein the ink regulator comprises a chemical identifier unit for chemically identifying the neutralizing component.

In an embodiment, compatible inks comprise a neutralizing component for neutralizing an immobilizing component in the wetting composition, wherein the ink is held in an ink cartridge, wherein the ink cartridge comprises a chemical identifier unit for chemically identifying the neutralizing component, and wherein the ink regulator is configured to interrogate the ink cartridge to determine whether the neutralizing component has been successfully identified.

In an embodiment, the ink regulator is configured to issue an incompatibility warning upon failure to identify the compatibility.

In an embodiment, the ink regulator is further configured to check ink color information.

In an embodiment, the ink regulator is further configured to issue an ink color warning if colored inks are not correctly placed in the ink holding unit.

An embodiment may comprise a flattening unit located to flatten the surface following the wetting and prior to printing.

According to a second aspect of the present invention there is provided a method of wet on wet garment printing, for printing on a textile surface, comprising:

providing ink in an ink holder;

providing a wetting composition;

identifying ink in the ink holder;

wetting the locations prior to printing using the wetting composition only upon successful identification of the ink; and printing onto locations of the textile surface using a print head obtaining ink from the ink holder.

In an embodiment, the identifying comprises checking a compatibility of the ink with the wetting composition.

In an embodiment, the operating the wetting applicator only upon successful identification of the ink is achieved by shutting off supply, to the wetting applicator, of the wetting composition upon unsuccessful identification of the ink.

The method may comprise providing the wetting composition to the surface through a digital printhead configured for printing according to digital printing data, and then sending the digital printing data to the wetting applicator only upon successful identification of the ink.

Unless otherwise defined, all technical and scientific terms used herein have the same meaning as commonly understood by one of ordinary skill in the art to which this invention belongs. The materials, methods, and examples provided herein are illustrative only and not intended to be limiting.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

The word "pigment" and "colorant" are used alternatively describing dye or pigment in the color inks.

Implementation of the method and/or system of embodiments of the invention can involve performing or completing selected tasks manually, automatically, or a combination thereof. This refers in particular to tasks involving control or operation of the printer.

Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
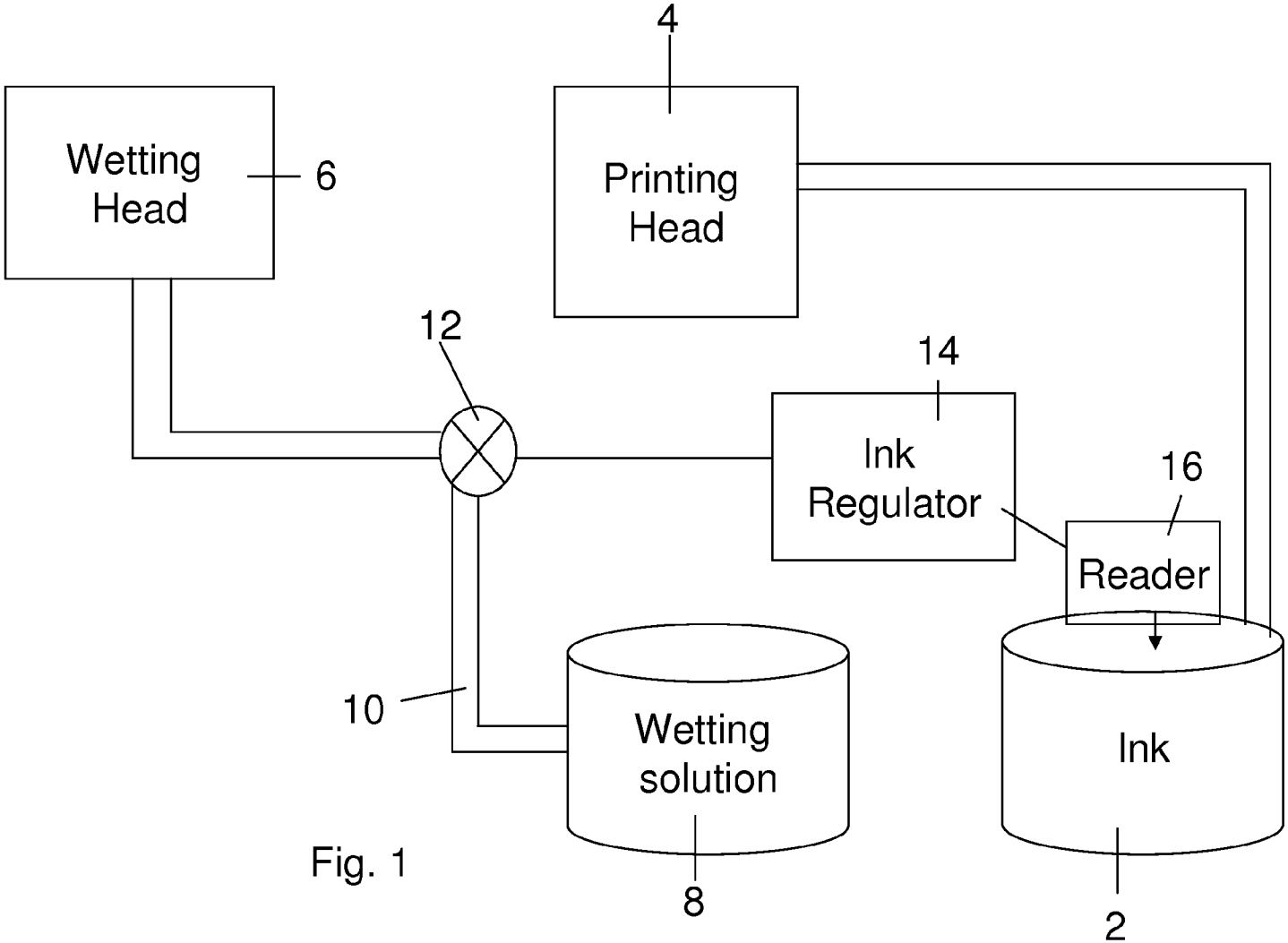
FIG. 1 is a simplified diagram illustrating a printing control system for a textile printer according to the present embodiments.

The present embodiments comprise applying a cutoff of the pretreatment solution application, when compatible ink is not detected in the printers Despite the dangers of non-compatibility, many users may wish to use inks that were not designed to be used with the wetting composition. The present embodiments provide a method of ensuring that if a user does try to use an ink that cannot be verified as safe to work with the wetting composition then the printer continues to operate but without the wetting feature.

The present embodiments may further be used to issue a warning when different color inks are misplaced in the machine ink compartment.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

As discussed hereinabove, in order to minimize or prevent liquid ink compositions from being soaked into an absorptive substrate, such as textile, an ink system of at least two liquid formulations has been provided in, for example, International Patent Publication No. WO 2005/15089 and International Patent Application No. PCT/IL2010/000645, which are incorporated herein by reference as if fully set forth herein, wherein the surface of the absorptive substrate is wetted with a colorless wetting composition which contains an agent that is capable of undergoing an instantaneous interaction with another compatible agent which forms a part of the colored inks which are jetted thereafter.

As discussed hereinabove, the way to afford a sharp image film on the substrate is to "freeze" or immobilize the droplets on contact with the substrate. Thus, a chemical and/or physical change takes effect in the ink composition instantaneously upon contacting of the ink with the substrate, and this chemical and/or physical change is effected by combining agents in the composition, which agents are designed to afford the immobilization of the inkjet droplets on the substrate, which will eventually lead to better and sharper images.

This instantaneous interaction causes the droplets of ink to immobilize on top of the surface. It can be said that one agent is sensitive to a property imparted by the other agent. By undergoing this instantaneous interaction, it can therefore be said that one of the suitable agents may neutralize the property of the other agent. Hereinafter, the suitable agents which interact to afford ink immobilization are referred to as a property-adjusting agent and a property-sensitive agent, as these terms are defined hereinbelow. The wetting composition may contain either of the property-adjusting and the property-sensitive agents, while the ink composition(s) contains the other agent, whereby the two agents are brought in contact only at the surface of the substrate and not before. The mechanical and operational means to set apart, identify and apply to combine the wetting composition and the ink composition(s) are discussed hereinbelow.

The term "immobilization", as used in the context of embodiments of the present invention, refers to the act of restriction or substantial limitation of flowability of a liquid, namely substantial reduction of the capability of a liquid to move by flow. For example, immobilization of a liquid can be effected by congelation of the liquid or solutes therein. Immobilization of droplets of liquid ink can be achieved, for example, by elevating the viscosity of the liquid ink composition such that the droplets are restricted from flowing once in contact with the substrate. As used herein, the term "immobilization" is not meant to include final polymerization and print fixation by crosslinking and curing reactions.

Reference is now made to FIG. 1 which is a schematic illustration of the control system for feeding ink and wetting composition to the wetting and printing heads in a wet on wet garment printing device for printing on a textile surface.

The system comprises an ink holder 2 for holding ink for printing.

A print head 4 prints onto locations of a textile surface using ink from the ink holder.

A wetting applicator or wetting head 6 wets the textile surface, or the part of the textile surface to be printed on prior to printing. Wetting is carried out using water or more typically a wetting composition, whose formulation is discussed in greater detail hereinbelow. The water or wetting composition is supplied from wetting composition container 8 via tube 10. Tube 10 is controlled by valve 12.

In an embodiment, the wetting applicator is a digital printing head such as an ink jet printing head. The digital printing head prints according to digital printing data which the printer provides. The printer may be designed so that digital printing data is sent to the wetting applicator only upon successful identification of the ink, so that if ink is not identified then the wetting applicator in effect receives blank printing data.

As an alternative the printing head may also be controlled by cutting off the supply of the wetting solution.

Ink regulator 14 identifies a compatibility of ink in the ink holding unit 2 with the wetting composition. Ink regulator 14 ensures that the wetting head 6 operates only upon successful identification of compatibility. Typically ink regulator 14 operates by ensuring that valve 12 is closed unless the ink in ink holder 2 is positively identified as being compatible with the wetting composition.

Ink regulator 14 may be connected to a reader 16 which obtains information from the ink holder about the inks stored therein. As will be explained in greater detail below the ink reader may electronically obtain ink labeling information from the ink cartridges or may carry out chemical sensing of the inks.

Figure 2:
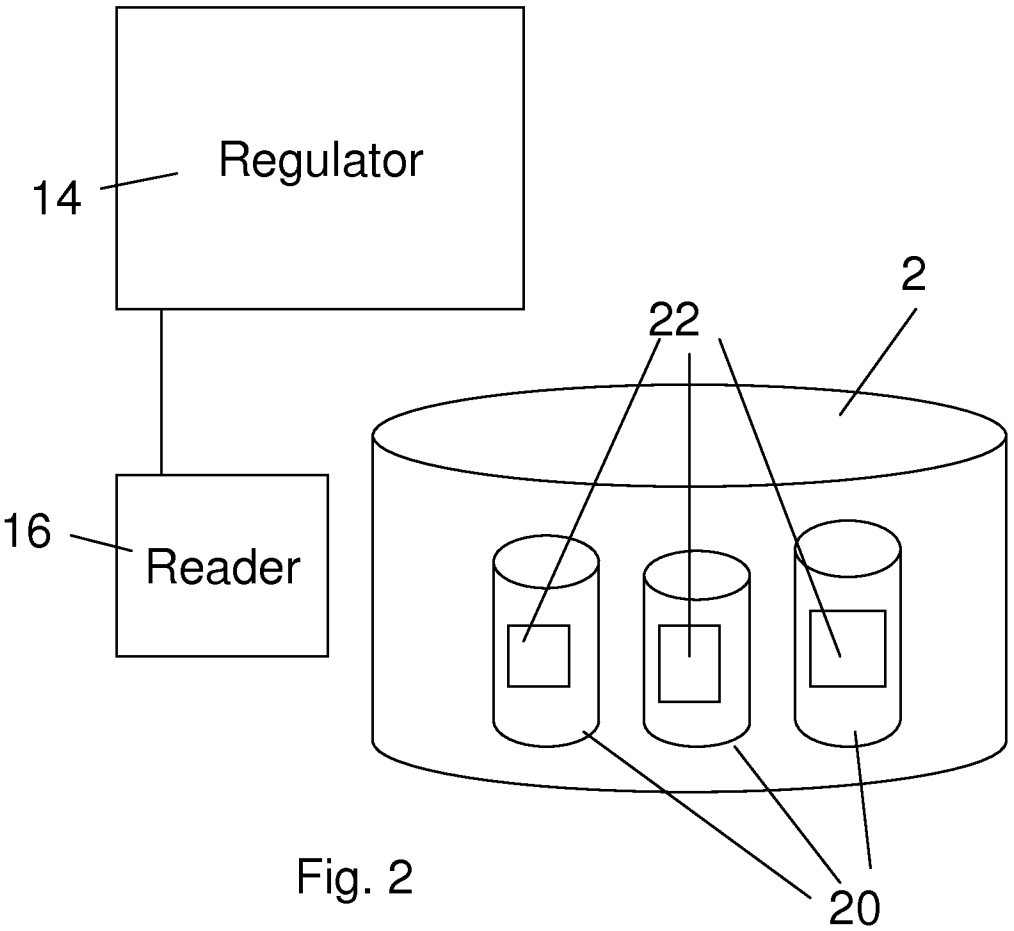
FIG. 2 shows the ink supply holder of the system of FIG. 1 in greater detail, with a non-contact ink reader.

Reference is now made to FIG. 2 which shows in greater detail the ink holder 2 and the ink regulator 14. As illustrated, ink is held in cartridges 20. Ink compatibility information is stored electronically in electronic storage media 22 in the cartridges, and the ink regulator uses the reader 16 to obtain the ink compatibility information by interrogating the electronic storage media.

In an embodiment, the electronic storage media in the cartridges comprises passive storage. The reader 16 is an active reader. An example of such a system is one in which the storage media on the cartridge is a magnetic storage such as a magnetic strip and the ink regulator comprises a magnetic reader. Another example is a microchip having contacts which connect with the reader when the cartridge is correctly positioned in the holder. The microchip may store the ink identification information in a ROM or Flash memory or the like.

In an alternative embodiment, the storage is a passive radio frequency identification (RFID) tag and the reader is an RFID reader. RFID tags comprise a microchip containing the data and a transmitter, and thus neither contact nor proximity is not needed between the reader and the cartridges and indeed a single reader unit can read tags on all the cartridges in the ink holder. Passive RFID readers do not need a power supply as they react by resonating to frequencies transmitted by the reader.

RFID is a technology that uses communication via electromagnetic waves to exchange data between a terminal and an electronic tag attached to an object. As mentioned, in passive RFID, the tag does not require its own power supply but simply stores information which can be read by a nearby reader.

An RFID tag may be added to the ink cartridge and the printer reads the tag.

The information tagged on the circuit within the tag may typically contain one or more of the following items of information:

1. part number of the product
2. batch number
3. production date
4. expiration date
5. Quantity of the materials.

In the present embodiments the tag includes an identification of the ink within the cartridge.

The RFID can then be read and used as a control to protect the operator, equipment and customers' products.

An advantage of RFID is that contact is not required between the reader and the ink cartridge. However as an alternative a simple microchip may be placed in the ink cartridge that can be read electronically through contacts that fit to corresponding contacts when the cartridge is placed in the machine.

As a further alternative, electronic storage media in the cartridges may comprise active storage such as microchip with RAM memory, in which case a small power source such as a button battery is included in the ink cartridge.

A further example of active storage media is an active RFID tag.

Figure 3:
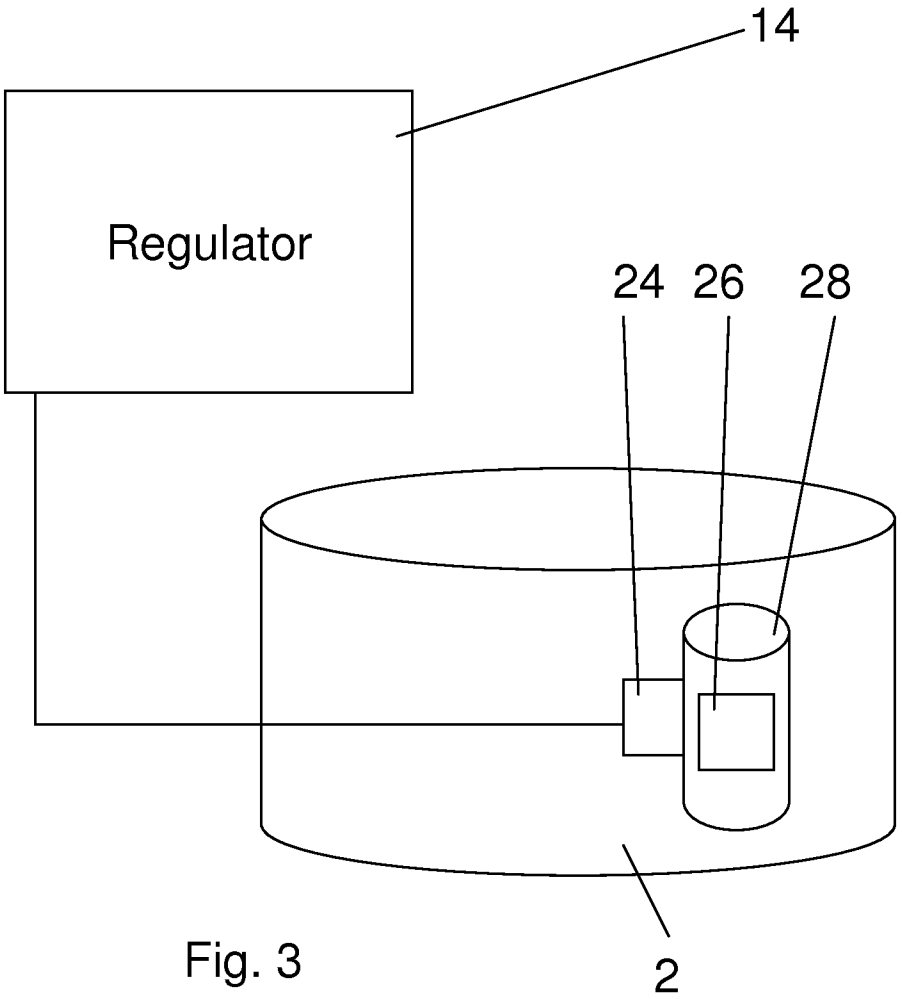
FIG. 3 shows the ink supply holder of the system of FIG. 1 in greater detail with a contact ink reader in contact with one of the ink cartridges.

FIG. 2 shows reader 16 as a non-contact reader. FIG. 3 shows a variation in which a contact reader 24 is provided to read information data from label 26 of cartridge 28.

In general, the wetting composition includes an immobilizing component which immobilizes the ink and more specifically prevents the ink from being absorbed into the fibres of the textile, bleeding and feathering. The immobilizing component may be volatile and may present risks to the textile fabric and to the environment if not neutralized. Thus compatible inks desirably comprise a neutralizing component for neutralizing the immobilizing component in the wetting composition.

As discussed hereinabove, one of the objectives of the present invention is to form a high quality inkjet image on an absorptive substrate, such as textile, in a safe and efficient manner. This objective can be achieved by using a system of at least two compositions, which are applied substantially either prior to image print or concurrently so as to combine on the surface of the absorptive substrate in situ during the printing process, and thereby cause the ink to congeal (immobilize) on the surface of the substrate. As further discussed above, the two compositions which combine in situ are a wetting composition, and an ink composition, the former a sprayable, and the latter a jettable, liquid. In the embodiment in which the wetting applicator is a print head, the wetting composition is jettable.

According to some embodiments of the present invention, the wetting composition is formulated with a carrier (solvent, typically water) and used to carry and deliver an ink immobilization component (also referred to herein as a property-adjusting agent), and does not contain a colorant and is thus substantially transparent and colorless, and intended not to leave a distinguishable mark on the substrate after the immobilization transformation has taken place.

According to some embodiments of the present invention, the ink composition comprises a colorant, a carrier and a neutralizing component (also referred to herein as a property-sensitive agent) in the form of, for example, a dispersant or an emulsified resin, which will cause immobilization of the ink (congelation) on the surface of the substrate due to an interaction between the property-adjusting agent in the wetting composition and the property-sensitive agent.

Hence, the property-adjusting agent and the property-sensitive agent interact with one-another, and are thereby substantially consumed in the process; each of the agents being able to neutralize the other. According to embodiments of the present invention, the term "immobilizing component" corresponds to either the property-adjusting agent or the property-sensitive agent, and the term "neutralizing component" corresponds to the counterpart agent.

It is therefore understood that the ink composition is compatible with the wetting composition and vice versa, and if only one of the compositions is used, or two incompatible compositions are used, the printing process will result in a discharge of unreacted components, which is generally unsafe, and may result in a poorer image Hence, one objective of the present invention is to prevent unsafe discharge of reagents during the printing process, and to assure the formation of a high quality image, both achieved by identification of compatibility of the wetting composition and the ink composition, and the prevention of some parts of the printing processes if chemical incompatibility is detected. In some embodiments, the part of the printing process that is prevented is the application of a wetting composition which contains a property-adjusting agent (an immobilization component), and wetting prevention is carried out if an ink composition which does not contain a property-sensitive agent (a neutralizing component) is detected in the printing machine.

The term "property-sensitive" refers to a component of a composition which is sensitive to a change in a particular chemical and/or physical property of the composition and as a result of such a change undergoes a chemical and/or physical change which effects the entire composition. Such sensitivity can manifest itself by, for example, the loss of its ability to stay emulsified, an event that leads to congelation.

The term "property" as used herein refers to a chemical and/or physical property of the ink composition, namely, a characteristic of the composition that is reflected by the chemical composition and/or a physical parameter of the composition. Representative examples include, without limitation, acidity (pH), metal atom complexation, dispensability, dispersibility, solubility, ionic strength, hydrophobicity, electric charge and the likes.

The term "pH" refers to the quantitative measure of the acidity or alkalinity of liquid solutions.

The phrase "metal ion complexation", as used herein, refers to the ability of some functional groups in certain substances, to act as ligands which bind to some metal atoms in a coordinative manner so as to form a metal-ligand complex. Such complexation may alter the chemical characteristics of these substances and render them more or less susceptible to chemical changes in their environment. As presented in International Patent Application No. PCT/IL2010/000645, some ink components are sensitive to this property in a manner that alter their ability to disperse a colorant in the ink. This sensitivity may be correlated or uncorrelated to a change in the pH of the medium.

The phrase "ionic strength" as used herein refers to the charge-weighted concentration of ions in solutions.

The term "hydrophobicity" as used herein refers to a quality of a non-polar molecule or group that has little affinity to water or other polar solvents. Hydrophobic groups on molecules in a polar solution tend to turn in on them or clump together with other hydrophobic groups.

The term "dispersibility" as used herein refers to the amount of a dispersed or emulsified species that will disperse in a specific carrier under given conditions. The reduction of dispersibility may be effected by a change in another chemical property such as pH, ionic strength, hydrophobicity or otherwise causing collapse of the dispersion or emulsion. As presented in International Patent Application No. PCT/IL2010/000645, a change in dispersibility can effect immobilization of a liquid ink composition.

The aforementioned properties may be inter-dependent, namely a change in one property effects a change in another property, thereby constituting inter-dependency therebetween. An example of such inter-dependency is a pH-dependent dispersibility and ionic-strength-dependent dispersibility, wherein the change in pH (the aforementioned acidity or alkalinity property) or the ionic-strength of a solution changes the dispersibility of one or more of its dispersed species. According to some embodiments of the present invention, there may exist inter-dependency between dispersibility and pH, namely the capacity to stay emulsified (dispersed) may be pH dependent.

The phrase "property-adjusting agent" as used herein refers to a component in either the liquid ink composition or the wetting composition which can affect the level of one or more chemical or physical properties of the counterpart composition upon the event when these counterparts come in contact and combine. By effecting a change in one or more chemical or physical properties, the property-adjusting agent causes the property-sensitive agent to undergo a chemical and/or physical change (such as congelation), as discussed herein. An exemplary property that can be adjusted by a property-adjusting agent is a pH level of the combined ink and wetting compositions, which cause immobilization of the ink.

Exemplary property-adjusting agents present in either the wetting composition or the liquid ink composition, according to some embodiments, include acids and/or bases that adjust the pH property; salts that adjust the ionic strength and electrical charge; or oxidizing agents, metal-oxides, reducing agents, radical-producing agents and cross-linking agents, all of which are selected for their capacity to interact with a property-sensitive agent and thereby cause coagulation and hence immobilization of the liquid ink composition.

The concentration of the property-adjusting agent should correspond adequately to the type and amount of the property-sensitive agent, so as to effect the desired immobilization of the ink and yet be substantially consumed (neutralized) during the immobilization reaction.

In general, it is understood that the interaction between the property-adjusting agent in the wetting composition and the property-sensitive agent in the ink composition, is meant to consume substantially all the property-adjusting agent or substantially reduce its concentration on the surface of the substrate after the immobilization reaction has occurred thereon. It is therefore understood that, for example, if an acid-containing wetting composition is used in conjunction with an incompatible ink composition, the acid, which is applied on the surface of the substrate will not be neutralized and will remain thereon and/or evaporate into the ambient environment. This release of un-reacted acid is prevented according to the provisions of the present embodiments.

Non-limiting examples of some ingredients and agents which can be included in the wetting and liquid ink compositions as immobilizing and neutralizing components, are described in, for example, International Patent Publication No. WO 2005/15089 and in International Patent Application No. PCT/IL2010/000645 which are incorporated herein by reference in their entirety.

The following describes a few representative and non-limiting examples, which present how the aforementioned objectives are met:

For example, in some embodiments, the wetting composition comprises an acid as a property-adjusting agent and the ink comprises a pH-sensitive component for effecting congelation upon contacting the acid. The acid-base interaction causes a resin or dispersant that is soluble in a basic composition to precipitate once it comes in contact with an acid, whereupon such solidification leads to a sharp increase in the viscosity of the composition (congelation). In the context of the present embodiments, use of an ink composition lacking a pH-sensitive component, which is also capable of neutralizing the acid, will cause the unsafe discharge of the acid during the application of the wetting composition, and will also result in an poorer image since the ink composition would not be immobilized on the wetted surface. Furthermore, the unreacted and un-neutralized acid may damage the substrate during or after the printing process, In other embodiments, adding polyvinyl alcohol with a low molecular weight to an aqueous-based ink composition and adding borax (sodium tetra borate) to the wetting composition may cause the formation of a gel upon contacting these two compositions. A similar effect may be achieved when using calcium acetate and isopropanol. Accordingly, absence of any one of the immobilization or neutralizing components in either the wetting composition or the ink composition may cause unwarranted conditions of unreacted reagent discharge and notable quality reduction of the final image.

The ink regulator of one embodiment comprises a chemical identifier unit for chemically identifying the neutralizing component (property-sensitive agent) within the ink in the cartridge and only allowing operation of the wetting head once a neutralizing component that is compatible with the immobilizing component (property-adjusting agent) has been identified.

In general, means for detecting the presence of a chemical substance in a composition are based on one or more sensors which generate a signal when coming in contact with the chemical substance. For example, to detect the presence of an acid or a base, a pH meter can be used, such that when detecting a pre-determined pH level will generate a signal that would be received and processed by the reader. Other chemicals can be detected by selecting an appropriate electrode which is calibrated to sense the concentration of the chemical substance and generate a signal. In a variation, the chemical identifier unit is actually contained in the ink cartridge itself. The ink regulator interrogates the ink cartridge electronically to determine whether the neutralizing component has been successfully identified.

In an embodiment the ink regulator 14 may additionally issue an incompatibility warning upon failure to identify compatibility.

The ink regulator 14 may further check ink color information, which information may also be provided in the tag. An ink color warning may then be issued to indicate that colored inks are not correctly placed in the ink holding unit. Thus garments are protected from being wasted by printing in the wrong colors.

Figure 4:
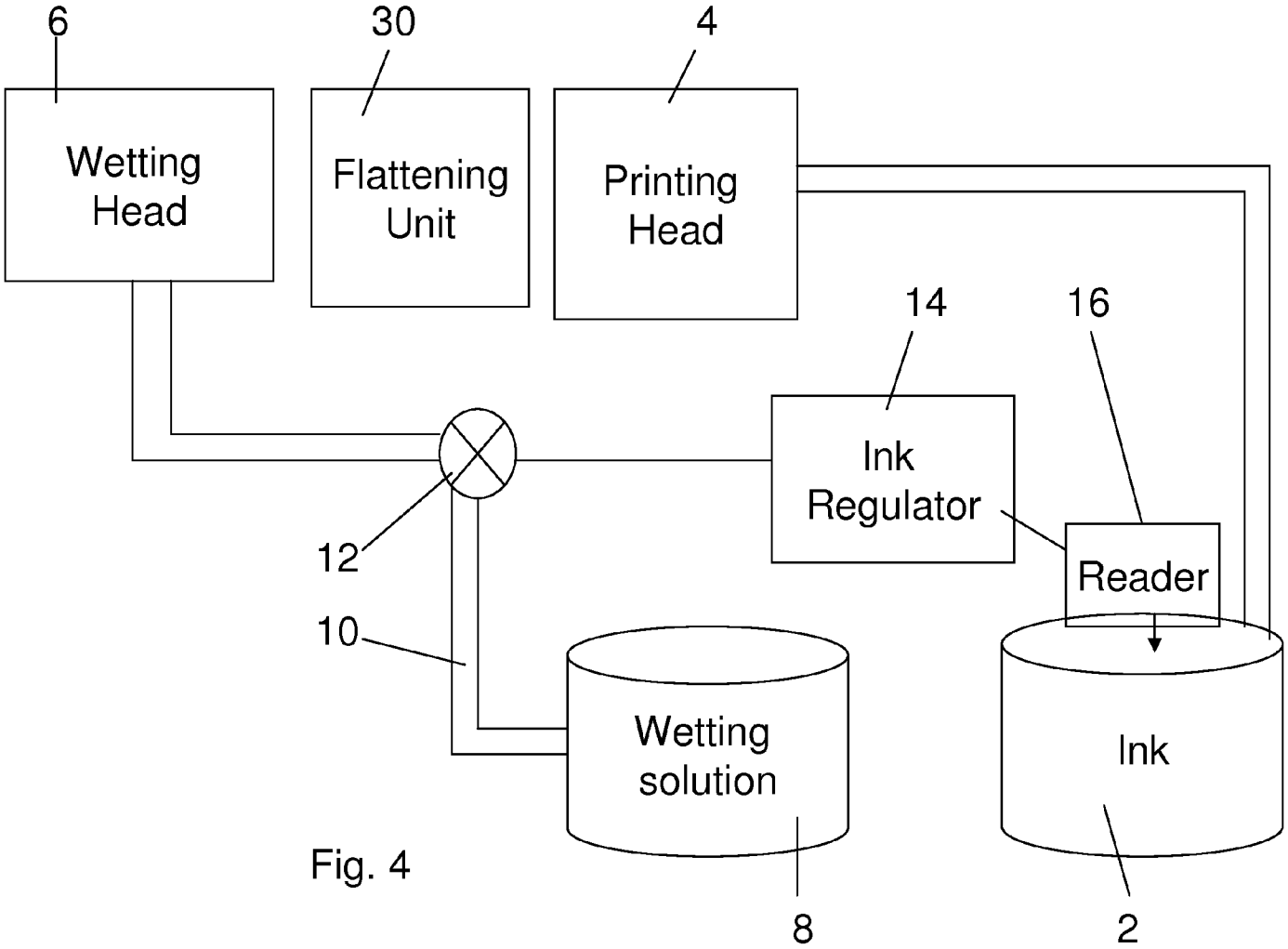
FIG. 4 shows a variation of the system of FIG. 1 in which a flattening or ironing unit is provided between the wetting unit and the printing unit.

Reference is made to FIG. 4, which illustrates an embodiment of wet on wet printing in which a flattening unit 30 is used to flatten or iron the garment surface following wetting and prior to printing. Parts that are referred to in previous figures are given the same reference numerals. The flattening unit is provided to ensure that a smooth surface is presented for printing despite the wetting.

Figure 5:
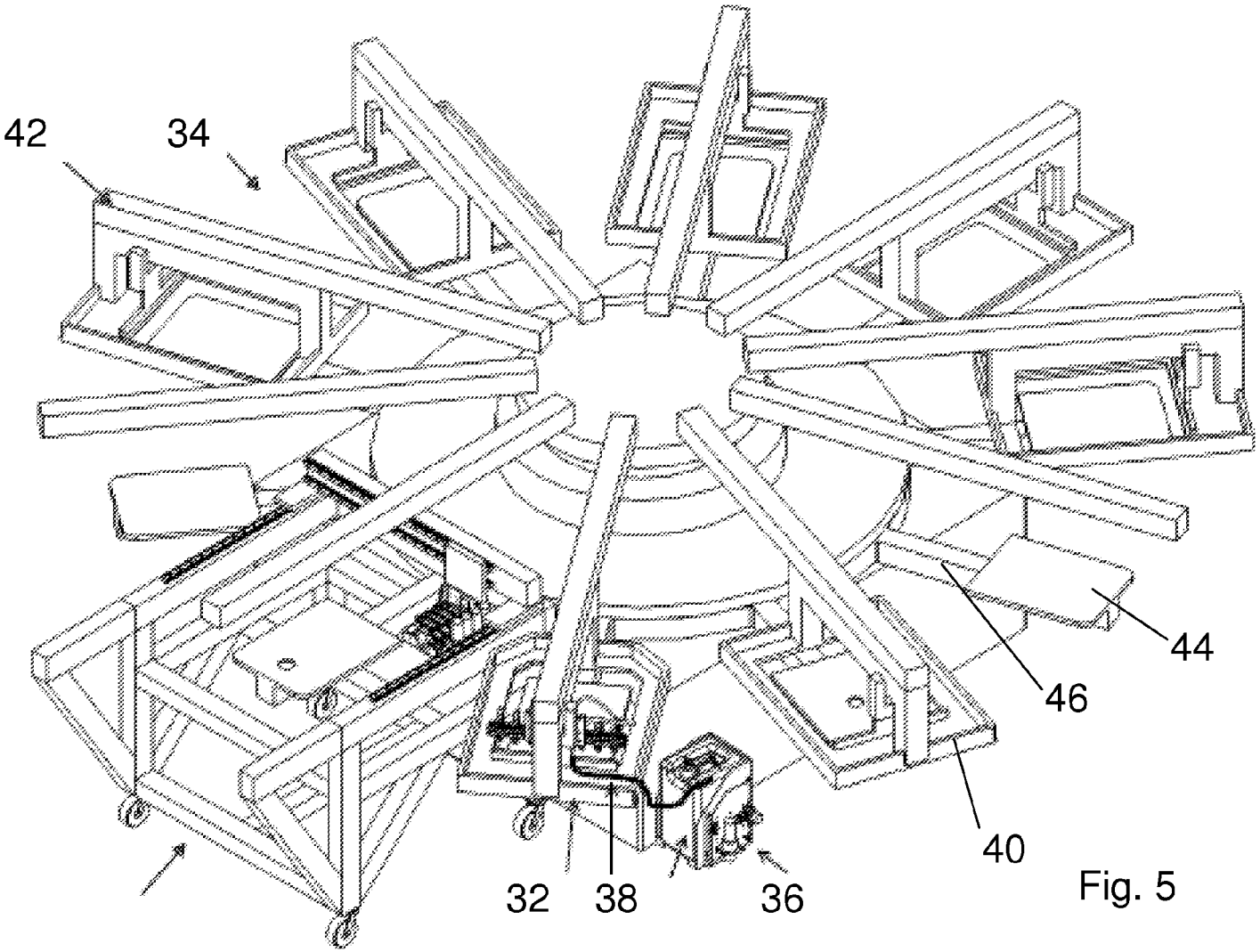
FIG. 5 is a simplified diagram showing the device of FIG. 1 incorporated into a carousel printer, according to another embodiment of the present invention.

Reference is now made to FIG. 5, which illustrates a printing device according to the present embodiments included as a station 32 within a carousel screen printer 34. Wetting composition is contained in tank 36 and printing and wetting heads and supply pipes are generally indicated by arrow 38. The digital printing unit is inserted, its base is anchored under the printing tray, while print heads etc are supported on an upper arm of the digital printer, and garments to be printed are placed on lower carousel trays 44 supported by lower arms 46.

Figure 6:
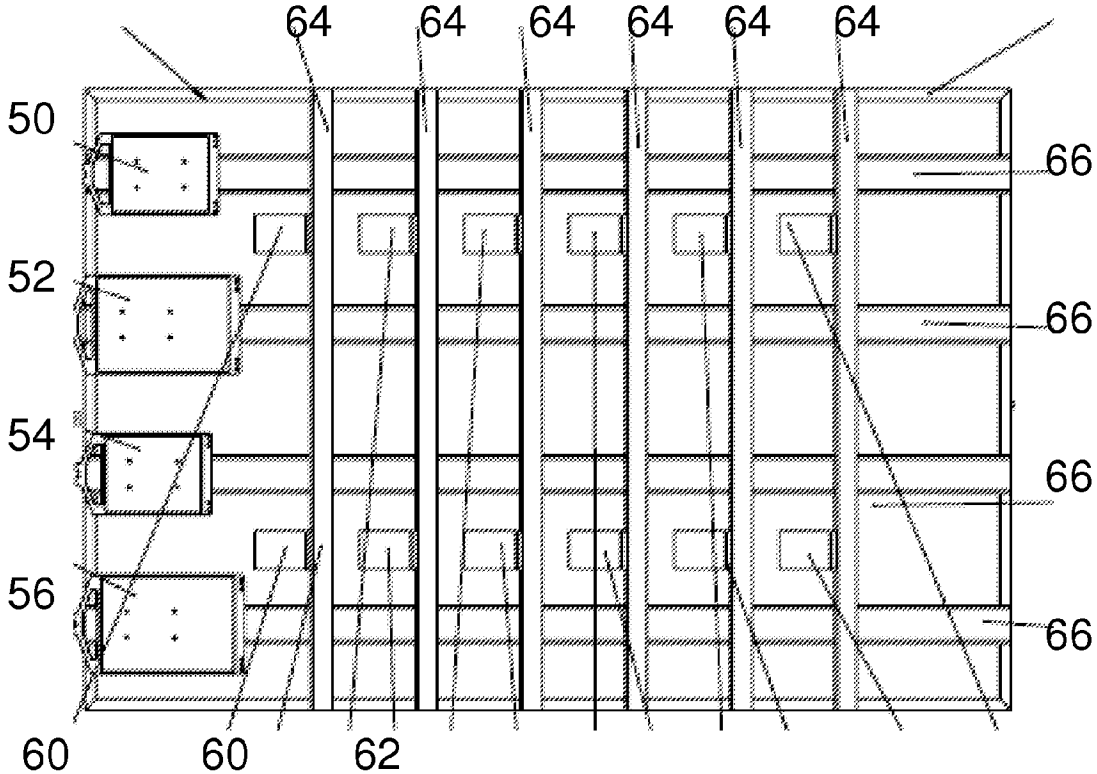
FIG. 6 is a simplified diagram showing the device of FIG. 1 incorporated into a matrix of print heads, according to another embodiment of the present invention.

Reference is now made to FIG. 6 in which the system is provided as part of a matrix of print heads. Four trays 50-56 carry garments for printing. Wetting heads 60 and printing heads 62, as well as post treatment heads are placed in series and the trays follow rails to reach the heads one after the other. The heads may be placed on cross rails 64 so that they can be shared between different trays on longitudinal rails 66.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A wet on wet garment printing device for printing on a textile surface comprising:

an ink holder for holding ink;

a printing head mounted for printing onto locations of said textile surface using ink from said ink holder;

a wetting applicator for wetting said locations prior to printing using a wetting composition; and an ink regulator configured to identify ink in said holding unit and to operate said wetting applicator for said wetting only upon successful identification of said ink, thereby allowing wetting and printing together upon said successful identification, and in the absence of said successful identification allowing printing without wetting.

2. The device of claim 1, wherein said operating said wetting applicator only upon successful identification of said ink is achieved by shutting off supply to said wetting applicator of said wetting composition upon unsuccessful identification of said ink.

3. The device of claim 1, wherein said wetting applicator comprises a digital printhead configured for printing according to digital printing data, and whereupon said device is configured such that said digital printing data is sent to said wetting applicator only upon successful identification of said ink.

4. The device of claim 1, wherein said ink is held in cartridges, ink compatibility information is stored electronically in electronic storage media in said cartridges, and said ink regulator is configured to obtain said ink identification information by interrogating said electronic storage media.

5. The device of claim 4, wherein said electronic storage media in said cartridges comprises passive storage, and said ink regulator comprises an active reader.

6. The device of claim 5, wherein said storage media comprises magnetic storage and said ink regulator comprises a magnetic reader.

7. The device of claim 5, wherein said storage media comprises a passive radio frequency identification—RFID—tag and said ink regulator comprises an RFID reader.

8. The device of claim 4, wherein said electronic storage media in said cartridges comprises active storage.

9. The device of claim 8, wherein said storage media comprises an active radio frequency identification—RFID—tag and said ink regulator comprises an RFID reader.

10. The device of claim 8, wherein said storage media comprises a microchip.

11. The device of claim 1, wherein said identification comprises identifying a compatibility of said ink with said wetting composition.

12. The device of claim 11, wherein compatible inks comprise a neutralizing component for neutralizing an immobilizing component in said wetting composition, and wherein said ink regulator comprises a chemical identifier unit for chemically identifying said neutralizing component.

13. The device of claim 11, wherein compatible inks comprise a neutralizing component for neutralizing an immobilizing component in said wetting composition, wherein said ink is held in an ink cartridge, wherein said ink cartridge comprises a chemical identifier unit for chemically identifying said neutralizing component, and wherein said ink regulator is configured to interrogate said ink cartridge to determine whether said neutralizing component has been successfully identified.

14. The device of claim 11, wherein said ink regulator is configured to issue an incompatibility warning upon failure to identify said compatibility.

15. The device of claim 1, wherein said ink regulator is further configured to check ink color information.

16. The device of claim 15, wherein said ink regulator is further configured to issue an ink color warning if colored inks are not correctly placed in said ink holding unit.

17. The device of claim 1, further comprising a flattening unit located to flatten said surface following said wetting and prior to printing.

18. A method of wet on wet garment printing, for printing on a textile surface, comprising:

providing ink in an ink holder;

providing a wetting composition;

identifying ink in said ink holder;

wetting said locations prior to printing using said wetting composition only upon successful identification of said ink; and printing onto locations of said textile surface using a print head obtaining ink from said ink holder, said method thereby allowing wetting and printing together upon said successful identification, and in the absence of said successful identification allowing printing without wetting.

19. The method of claim 18, wherein said identifying comprises checking a compatibility of said ink with said wetting composition.

20. The method of claim 18, wherein said operating said wetting applicator only upon successful identification of said ink is achieved by shutting off supply to said wetting applicator of said wetting composition upon unsuccessful identification of said ink.

21. The method of claim 18, comprising providing said wetting composition to said surface through a digital printhead configured for printing according to digital printing data, and wherein said digital printing data is sent to said wetting applicator only upon successful identification of said ink.

* * * * *